73-151.5 SR
4/23/85 OR 4,512,186

United States Patent [19]

Edwards

[11] Patent Number: 4,512,186

[45] Date of Patent: Apr. 23, 1985

[54] DRILL RATE AND GAS MONITORING SYSTEM

[75] Inventor: Bruce K. Edwards, Jackson, Miss.

[73] Assignee: Location Sample Service, Inc., Rankin County, Miss.

[21] Appl. No.: 488,941

[22] Filed: Apr. 27, 1983

[51] Int. Cl.[3] ..... E21B 47/00

[52] U.S. Cl. ..... 73/151.5

[58] Field of Search ..... 73/151.5; 175/40; 346/33 WL

[56] References Cited

U.S. PATENT DOCUMENTS

| | | | |
|---|---|---|---|
| 3,504,370 | 3/1970 | Rebilly | 73/151.5 X |
| 3,777,560 | 12/1973 | Guignard | 73/151.5 |
| 3,982,432 | 9/1976 | Hammond | 73/151.5 |

OTHER PUBLICATIONS

Uren, L. C. Petroleum Production Engineering 3rd Ed. 1946, McGraw-Hill Book Co., Inc., pp. 650–663.

*Primary Examiner*—Jerry W. Myracle

*Attorney, Agent, or Firm*—Richards, Harris, Medlock & Andrews

[57] ABSTRACT

Method and apparatus for logging a well during drilling operations to record drilling fluid gas and rate of penetration as a function of depth. The system comprises elements for producing a succession of depth signals in response to applied inputs and applying the depth signals to a variable output scaler. The scaler is comprised of a set of retriggerable monostable units, each having different time constants. The scaler output is employed to actuate the index drive of a recorder to provide a desired logging scale. The scaler output is also employed to reset a bank of digital counters which are pulsed by clock signals from a time base generator. The values in the digital counters are applied to a digital-to-analogue converter. The output from the digital-to-analogue converter is recorded as a function of the depth index along with the gas signal. Latch elements are interposed between the digital counters and the converter. The latch elements may be switched between a latching state so that the rate of penetration signal is recorded in a point-to-point format or in a non-latching state so that the rate of penetration signal is recorded in a bar pattern format.

8 Claims, 3 Drawing Figures

DRILL RATE AND GAS MONITORING SYSTEM

DESCRIPTION

1. Technical Field

This invention relates to the logging of wells during drilling operations and more particularly to the measurement and congruent recording of drilling fluid gas and rate of penetration as a function of depth.

2. Background of the Invention

Typically, wells are extended into the earth's crust to desired subterranean locations, e.g. oil or gas bearing formations through the application of rotary drilling techniques. In the rotary drilling of a well, a drilling fluid is circulated through the well in order to remove cuttings from the bottom of the well. Typically, this is accomplished by pumping the drilling fluid downwardly through the drill string within the well and then upwardly to the surface of the well through the annulus surrounding the drill string. The drill cuttings are entrained in the drilling fluid and brought to the surface with the fluid. In addition to removing cuttings, the drilling fluid also serves to cool and lubricate the drill bit, and in the case of systems employing downhole drill motors, it functions as a power fluid for the drill motor.

In the course of such operations, it is a conventional practice to measure and record various drilling parameters. In every instance, the depth of the well is recorded. In a relatively simple format, this may be accomplished by means of a displacement sensitive transducer such as a measuring sheave mounted to be driven by a crown block pulley or a suspending cable from the draw works to sense the downward movement of the drill string. A somewhat more sophisticated system is disclosed in U.S. Pat. No. 3,777,560 to Guignard. In this system, a displacement responsive transducer is mounted on the drilling rig and functions to produce two sets of electrical signals representative of the direction and incremental distance traveled by the drill string. Concommitantly, a force responsive transducer coupled in the drill string produces another set of electrical signals which are representative of incremental changes in the length of the drill string. These signals are compared and applied to a reversible counter circuit to arrive at electrical pulses representative of the net advance of the bore hole. The electrical pulses are applied to a frequency-to-voltage converter circuit. Since the pulse rate of the electrical pulses is proportional to the rate of penetration, the output of the frequency-to-voltage converter circuit provides an average of the instantaneous drilling speed. The output from this circuit is applied to a depth recorder driven by a stepping motor which is generated by output pulses from the reversible counter.

In addition to depth and rate of penetration, other drilling parameters which may be measured include rate of rotation of the drill pipe, torque, hook load, and drilling fluid circulation rate. It is often times desirable to also carry out mud logging operations in the course of the drilling procedure. This includes an examination of the drilling fluid properties and also analysis of the drilling mud for the presence of liquid or gaseous hydrocarbons. Much of this data may be automatically recorded as described, for example, in Uren, L. C., *Petroleum Production Engineering,* "Oil Field Development", McGraw-Hill, New York (1946), pages 651–662. As there disclosed, the unit instrument panel may display or record pump stroke, drilling rate, weight and gas. The rate of penetration conventionally is expressed in time per unit of length, although the inverse indication, e. g. feet per minute or feet per hour may also be used.

DESCRIPTION OF THE INVENTION

In accordance with the present invention, there are provided a new and improved process and system for logging a well during rotary drilling operations in which a rate of penetration measurement is derived from a depth signal and recorded as a function of depth congruently with a signal representative of the quantity of gas detected in drilling fluid returns. In carrying out the process of the present invention, a series of incremental depth signals are generated as the drill string is advanced during normal drilling operations. A recorder is indexed in response to the depth signals to produce an index of the well depth. Hydrocarbon gas is detected in the drilling fluid returns from the well and a signal representative of the quantity of the gas is applied to a recorder where it is recorded as a function of the depth index. A signal representative of the rate of penetration of the drill string is produced by gating a time base signal in response to the incremental depth signals. The rate of penetration signal is applied to the recorder where it is recorded as a function of the depth index congruently with the gas signal.

The sytem of the present invention comprises a depth signal generator and a recorder having an index drive and at least two recording channels. The depth signals from the generator are applied to a variableoutput scaler which is adapted to produce a plurality of scale signals having different values. The scaler responds to the depth signal to produce a selected one of the scale signals. Means responsive to the scale signals actuate the index drive of the recorder by an amount proportional to the value of the scale signal. The system further includes means to apply a gas signal to one of the recording channels of the recorder to provide a record of the quantity of gas detected in the drilling fluid as a function of the well depth index. The system also includes means responsive to the depth signal for producing a signal representative of the rate of penetration of the drill string and for applying this signal to another recording channel of the recorder means so that it is recorded along with the gas signal.

DESCRIPTION OF PREFERRED MODES

As noted previously, the rate of penetration and the quantity of gas in the drilling mud returns are two parameters which are commonly measured in the course of rotary drilling operations. The present invention provides a means for economically and reliably deriving a rate of penetration measurement from a depth signal and for recording this measurement along with a gas measurement as a function as depth. The invention may be employed in conjunction with simple depth indicators of the type found on most drilling rigs and the two recorded measurements are maintained in a congruent relationship as the logging scale is changed from one value to another.

Figure 1:
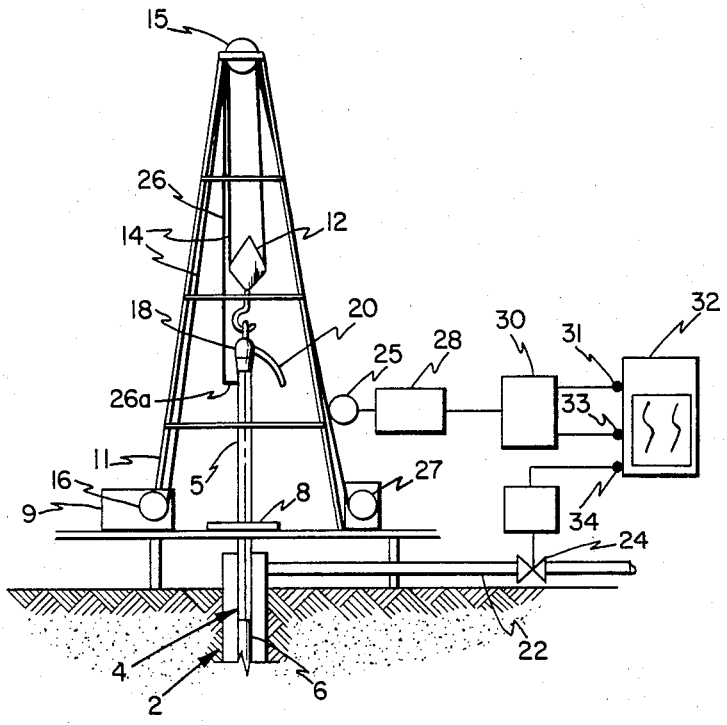
FIG. 1 is a schematic illustration of a rotary drilling rig equipped with a monitoring system in accordance with the present invention.

Turning now to FIG. 1, there is shown a rotary drilling rig for drilling a well 2 through the earth's crust. Drilling of the well proceeds utilizing a rotary drill bit (not shown) which is attached to the bottom of a drill string 4 comprised of a kelly 5 and joints of drill pipe 6. The kelly is typically of a hexagonal or square cross section and extends through a rotary table 8. The kelly is received within the rotary table in a slidable, torque applying relationship by means of a kelly bushing (not shown) and the rotary table is powered by a prime mover 9 through a suitable drive mechanism in a manner well known to those skilled in the art.

The drill string is suspended from the derrick structure 11 of the drilling rig by means of a hook and traveling block 12. The traveling block is suspended by means of a draw works hoisting cable 14 from the crown block 15 in the upper portion of the derrick. The traveling block is raised and lowered by operation of a draw works drum 16 on the prime mover to which the hoisting cable 14 is secured. The kelly 5 is connected to the hook by means of a rotary swivel 18 which permits rotation of the drill string relative to the traveling block. Drilling fluid is circulated through a flexible hose 20 into the swivel and down the interior passage of the drill string to the bottom of the well. The drilling fluid is recovered from the well through a mud return line 22 at the well head. The drilling fluid is passed to a mud system (not shown) normally comprising a mud screen, mud pumps and circulation pumps for recirculating the mud into the drill string via the flexible hose 20.

A gas detector 24 is mounted in the mud return line to detect the quantity of gas in the drilling fluid and to generate an output signal representative thereof. The gas detector may be of any suitable type. For example, it may take the form of a "hot wire" detector in which gas is withdrawn from the drilling fluid by a gas trap and catalytically combusted in the presence of one or more thermistor elements. The thermistor elements are connected in a bridge circuit to produce an analogue voltage signal proportional to the quantity of gas detected.

The drilling rig is equipped with a depth counter which includes a displacement transducer that senses downward movement of the drill string. As indicated schematically, the depth counter includes a measuring sheave 25 which operates on a wire line 26 which extends from a reel 27 over a pulley (not shown) at the crown block and downward where it is connected to the kelly as indicated at 26*a*. Thus, as the drill string is lowered into the hole during drilling operations, rotation of the sheave by the cable, typically one revolution for each one foot increment of depth, is sensed to provide a depth measurement. The sheave 25 is disengaged either manually or automatically when the bit is not drilling on the bottom of the hole, e.g. when coming out of the hole during trips and the like. An example of a suitable depth indicator is a drilling recorder available from the Totco Division of Baker International Corp. and identified as Part No. 262902-101.

It will be recognized that the invention may be employed in conjunction with various other depth indicators. For example, it is a conventional practice, to mount a measuring sheave in the crown block so that it responds to rotation of a crown block sheave. The output from this measuring sheave may be used to drive a mechanical counter on the rig floor.

The output of the depth counter is sensed by a pickup unit 28 which produces a depth signal for each increment of depth. In the preferred embodiment invention as described in greater detail hereinafter, the pickup responds to alternating signals from the counter to generate a depth signal, indicative of an increment of depth, for each set of these signals. The ouput from the pickup unit 28 is applied to an analysis and control unit 30 which includes a scaler and a means for deriving a rate of penetration signal from the depth signal. The scaler output is applied to the index drive 31 of a multi-channel recorder 32. For example, where recorder 32 is a strip chart recorder, the output of the scaler is employed to advance the chart drive as a function of depth. The rate-of-penetration signal and the gas signal are applied to recording channels 33 and 34, respectively, to provide a record of these measurments as a function of depth.

The scaler has variable relative output, i.e. provides a plurality of scaling factors, so that the recorder can be indexed to provide a selected one of a plurality of logging scales. For example, the recorder may be indexed to provide a logging scale of one inch, two inches or five inches per 100 feet of depth. Regardless of variations in the logging scale, both the gas signal and the rate of penetration measurment are recorded congruently as a function of depth so that they can be instantly compared.

Figure 2:
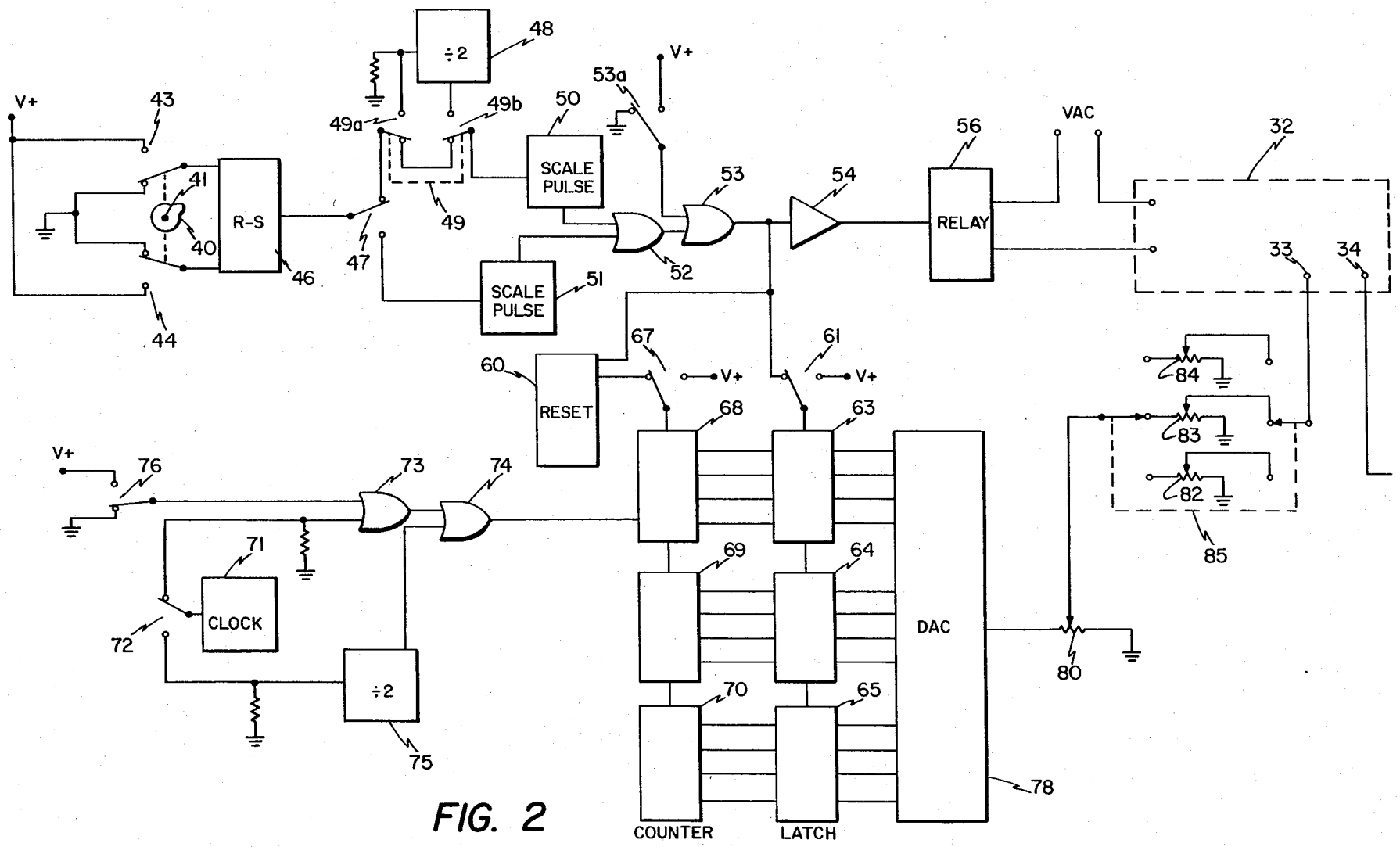
FIG. 2 is a block schematic of circuitry employed in a preferred embodiment of the invention.

Referring now to FIG. 2, there is illustrated circuitry employed in a preferred embodiment of the invention. A single lobe cam 40 is mounted on a shaft 41 which rotates as a function of depth. For example, the cam may be mounted on the rotating shaft of the mechanical counter (not shown) associated with a drilling recorder of the type described previously. The cam operates switches 43 and 44 which are mounted on opposite sides of the shaft 180° apart. The switches are normally biased to the ground position shown and when actuated by the cam, are moved to the contacts for a DC voltage source V+. Thus, as the cam is rotated, the switches alternately transmit the DC voltage V+ or ground to an R-S flip-flop unit 46. The R-S flip-flop 46 operates in a manner well known to those skilled in the art to go to a high voltage "on" state when the voltage pulse is applied to the S input and to a low (zero) voltage "off" state when the DC voltage is applied to the R input. Thus, two voltage pulses are applied sequentially to the flip-flop unit 46 for each complete revolution of shaft 41, indicative of a depth increment of one foot.

The use of the bi-stable flip-flop which requires the input of two different signals in the proper sequence for the generation of a depth increment signal reduces the likelihood that false signals will be produced because of vibrations occurring during the drilling operation. For example, the opening and closing of a pickup switch more than once during one revolution of the counter shaft because of rig floor vibrations and the like will not cause the generation of additional erroneous depth signals. The use of a mechanically operated pickup unit, as shown, will usually be preferred. However, it will be recognized that other systems may also be employed. For example, the pickup unit may take the form of magnetic pickups in the circuit in place of switches 43 and 44. The magnetic pickup similarly would be located 180° apart and would be activated by a permanent magnet mounted on the counter shaft.

The output from flip-flop 46 is applied to the scaler unit which comprises a selector switch 47, a divide-by-two flip-flop unit 48 under control of a gang switch 49 and two retriggerable monostable units 50 and 51 connected to an OR gate 52. Each of these units are configured to detect the rising edge output of the flip-flop 46 to go to the quasi-stable high voltage state for a predetermined time before returning to the stable state. These units are not affected by the falling edge of the output from the RS flip-flop. The duration of the pulse output from units 50 and 51 is determined by an RC averaging circuit (not shown) for each unit in a manner well known to those skilled in the art. Each of the outputs from the monostable units corresponds to a desired logging scale. By way of example, the pulse durations from units 50 and 51 may be about 0.5 and 1.25 seconds, respectively, corresponding to logging scales of two inches and five inches, respectively.

When the selector switch 47 is in the position shown, the output from flip-flop unit 46 is applied through switch 49 directly to retriggerable monostable unit 50 and the input of unit 51 is connected to ground. The output from unit 50 provides a two-inch logging scale. The switch 47 can, of course, be moved to the lower position to select the retriggerable monostable 51 (to provide a five-inch scale) and connect the input of unit 50 to ground. With the switch 47 in the position shown and switch 49 in the upper position, the divide-by-two unit is connected in series between unit 46 and unit 50. The output of the R-S flip-flow is then applied via pole **49*a* to unit 48 which produces one output pulse in response to each pair of pulses from the R-S flip-flop. The output from unit 48 is applied via pole 49*b* to the retriggerable monostable 50** which functions as before, but in this case to provide a one-inch scale.

The output from the selected one of the retriggerable monostables is applied through OR gates 52 and 53 to a buffer amplifier 54. The buffer amplifier responds to the scaler output to produce a driving current to operate a solid state relay 56 for the duration of the scaler ouput. When the relay 56 is in the "on" position, voltage is supplied from an AC voltage source VAC to the motor windings of the chart motor of recorder 32 to move the chart paper a designated distance, as indicated by the monostable unit selected. Thus, with switches 48 and 49 in the positions shown to produce a two-inch log, the paper is moved 0.02 inch in response to the scaler output. With switch 49 in the upper position to produce a one-inch log, the paper is similarly moved in increments of 0.02 inch but at a frequency of once for every two pulses from unit 46, thus providing a one-inch log. On the other hand, if the switch is moved to the contact to select the monostable unit 51, the paper will be moved 0.05 inch to produce a five-inch log. OR gate 53 and an input switch **53*a*** provide a means for adjusting the alignment of the chart paper. The switch is spring biased to normally contact ground during operation of the system. In order to advance the chart paper to provide a desired alignment, this switch is pushed to connect the OR gate input to D.C. voltage source V+.

The recorder 32 may be of any suitable type. A chart driven chart recorder of the type described usually will be preferred from the standpoint of convenience and reliability, but recorders having other types of index drives may also be used. For example, the output from the scaler may be employed to index a pen carriage along a stationary chart.

The output from OR gate 53 is also applied to a retriggerable monostable unit 60 and when switch 61 is in the position shown, to a latch bank composed of quad latches 63, 64 and 65. The one-shot unit 60 is configured to respond only to the falling edge of the output from OR gate 53 to produce a positive pulse which is of a relatively short duration in comparison with the OR gate output. For example, where the duration of the OR gate output will be measured in terms of seconds or fractions thereof, depending upon the scaler unit selected, the output from unit 60 may be a millisecond or less. The output from unit 60 is applied through switch 67 to a digital counter unit which is shown as comprising three 4-bit binary counters 68, 69 and 70. The output from unit 60 functions to reset the binary counters 68, 69 and 70 to a reference value, normally zero, more or less instantaneously in comparison with the other time constants of the circuit. Switch 67 provides a means for manually resetting the binary counters during calibration of the system. This may be accomplished by connecting the switch to DC voltage source V+.

A time base generator 71 provides for the generation of a sequence of clock pulses which are used to drive the digital counters. Where the scaler output is set for a two-inch or five-inch log, the clock pulses are applied through a switch 72 to one input of an OR gate 73. The clock pulse output from gate 73 is applied via OR gate 74 to the digital counters. Where the scaler output is set for a one-inch log (with switch 49 in the upper position), switch 72 is reversed from the position shown and the output from the time base generator is applied through a divide-by-two flip-flop 75 to the input of OR gate 74. Thus, the clock frequency applied from OR gate 74 to the digital counters is reduced by one-half so that it is consistent with the scaler setting. One input of the OR gate 73 is connected through a switch 76 to ground. The switch 76 is mounted on the disengage arm of the drilling depth counter so that during drilling operations the switch is in the position shown allowing the clock signals to be registered by the counters. When drilling operations are ceased and the depth counter disengaged either automatically or manually by the driller, switch 76 is reversed connecting the input of gate 73 to DC voltage source V+. The steady state voltage applied through OR gates 73 and 74 prevents counting of the clock pulses during the period of disengagement.

With the switch 61 in the position shown, the quad latches 63, 64 and 65 function to hold the last count value from counters 68, 69 and 70 to provide a rate of penetration signal for recording in a point-to-point format. Thus, during the time of the voltage output from OR gate 53, the latches are held in the open unlatched position. At the falling edge of the OR gate output, the quad latches hold the count values in the digital counters which are then reset by the output from unit 60 to start a new counting cycle. The output from the latch unit is applied to a digital to analogue converter 78 which produces a voltage signal representative of the count value now stored in the latch means. The output from the digital to analogue converter is applied via a recording scaler to one channel of the recording unit 33. The recording scaler comprises a coarse attenuator 80 which may be used for calibration purposes and three full-scale attenuators 82, 83 and 84, which provide for different full-scale pen movements for the rate of penetration recording. For example, the resistors in attenuators 82, 83 and 84 may be selected to provide full-scale pen movement corresponding to 9 minutes per foot, 36 minutes per foot and 72 minutes per foot, respectively. A gang switch 85 is employed to select the attenuator providing the desired recording scale while completely isolating the others from the circuit to provide for a good zero reference. Thus, as shown in the drawing attenuator 83 is selected to provide an output to channel 33 corresponding to a full scale of 36 minutes per foot. The output from the gas measuring device (FIG. 1) is applied to the other recording channel 34 of the recorder.

If it is desired to record the rate of penetration signal in a bar pattern format, switch 61 is connected to the DC voltage source V+ so that the latches 63, 64 and 65 are continuously held in the open or unlatched condition. In this case, the count values from the digital counters 68, 69 and 70 are applied directly to the digital to analogue converter which, in turn, produces a gradually increasing voltage output during the counting cycle. When the counters are reset, at the conclusion of each operation of the recorder index drive, the voltage output from unit 78 drops to zero and, thereafter, begins to increase with the new count rate.

In the embodiment illustrated, a single monostable unit is employed to provide two scale signals by selectively dividing the scaler input. In this case, the smaller scale log is, in effect, an average measurement taken over a longer depth increment, e.g., over a two-feet interval for the one-inch log as contrasted with a one-foot interval for the two-inch log. This is advantageous in that it avoids the necessity of having to advance the chart paper in extremely small increments for the smaller scale. However, it will be recognized that the scaler output for the one-inch log could also be provided by a third retriggerable monostable which operates similarly as units 50 and 51 but with a shorter time constant, 0.25 second in the example given. In this modification, the divide-by-two flip-flops and their associated circuit components can be eliminated and the clock frequency of the signal applied to the digital counters will be the same for all scaler settings. The digital circuit components employed in the circuit of FIG. 2 may take the form of standard CMOS integrated circuits.

Figure 3:
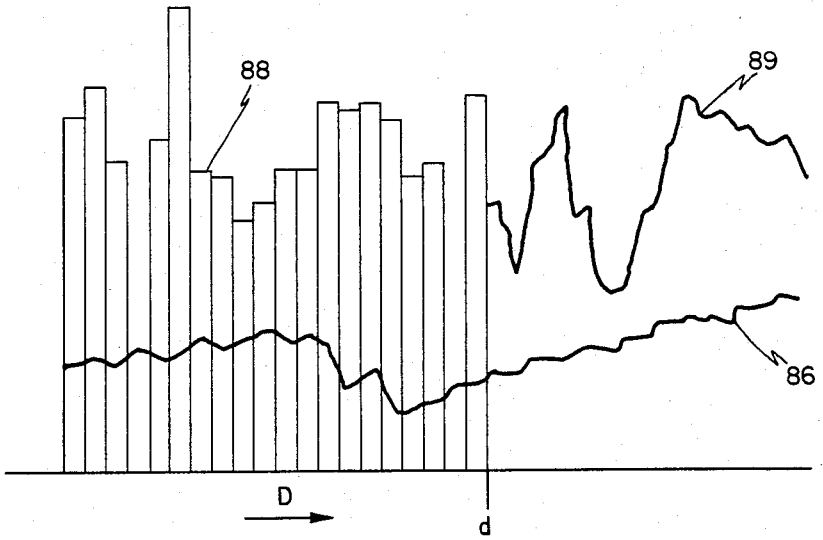
FIG. 3 is illustrations of records obtained by two recording modes of the present invention.

FIG. 3 illustrates the two recording formats. In each case, the recorded parameters are shown in ordinate versus the depth index "D" on the abscissa. Curve 86 represents the recorded gas signal and curve segment 88 represents the rate of penetration recorded in a bar graph format. At depth "d" switch 61 is reversed and curve segment 89 shows the rate of penetration recorded in the point-to-point format.

Having described specific embodiments of the present invention, it will be understood that modifications thereof may be suggested to those skilled in the art, and it is intended to cover all such modifications as fall within the scope of the appended claims.

What is claimed is:

1. In a system for monitoring the drilling of a well with a rotary drill system of the type having a bit secured to the bottom of a drill string and wherein a drilling fluid is circulated through said well and returned to the surface thereof, the combination comprising:

a. recording means having an index drive and at least two recording channels;

b. means for producing a succession of depth signals representative of the incremental advance of the drill string during drilling operations;

c. variable scaler means responsive to said depth signals for producing one of a plurality of scale signals having different relative values and for selecting said one of said signals;

d. means responsive to the scale signal from said scaler means to actuate the index drive of said recorder by an amount proportional to the value of said scale signal to produce a depth index;

e. means for applying a gas signal to a recording channel of said recording means to provide a record of the quantity of gas detected in drilling fluid returned to the surface as a function of said well depth index;

f. means responsive to said depth signal for producing a signal representative of the rate of penetration of the drill string and for applying said rate of penetration signal to another recording channel of said recording means to provide a record of said rate of penetration signal as a function of said well depth index.

2. The combination of claim 1 wherein said depth signal means comprises means for generating alternating first and second signals, each set of which is representative of the incremental advance of the drill string, and means responsive to the sequential application of said first and second signals for generating a depth signal for each increment of depth.

3. The combination of claim 1 wherein said rate of penetration signal means comprises a first mode in which said signal is in a format to produce a bar pattern record and a second mode in which said signal is in a format to produce a point-to-point pattern record, and switch means for selecting one of said modes.

4. In a system for monitoring the drilling of a well with a rotary drill system of the type having a bit secured to the bottom of a drill string and wherein a drilling fluid is circulated through said well and returned to the surface thereof, the combination comprising:

a. means for producing a succession of depth signals representative of the incremental advance of the drill string during drilling operation;

b. variable scaler means comprising a plurality of retriggerable monostable units which respond to an applied input pulse to produce output pulses of different values;

c. switch means for selectively connecting the output of said depth signal means to one of said retriggerable monostable units;

d. a recorder having an index drive and at least two recording channels;

f. means responsive to the output signal from said scaler means to actuate the index drive of said recorder by an amount proportional the value of said output signal to produce a depth index;

g. a time base generator for generating a sequence of clock pulses;

h. resettable digital counting means responsive to the output from said time base generator to produce a count value representative of rate of penetration;

i. means for resetting said counting means to a reference value in response to the output signal from said scaler means;

j. means for applying a function representative of the value in said count means to a recording channel of said recorder to provide a record of rate of penetration as a function of depth;

k. means for applying a gas signal to another recording channel of said recorder to provide a record of the quantity of gas detected in the drilling fluid returns as a function of said well depth index.

5. The combination of claim 4 wherein said depth signal means comprises means for generating alternating first and second signals, each set of which is representative of the incremental advance of the drill string during drilling operations and RS flip-flop means responsive to the sequential application of said first and second signals for generating an output pulse representative of an increment of depth.

6. The combination of claim 6 further comprising a digital to analog converter for converting the digital count from said counting means to an analog signal which is provided to said recording channel and latch means interposed between said counting means and said digital to analog converter adapted to hold the count value in said counting means from one depth increment pulse to the next depth increment pulse whereby said rate of penetration signal is recorded in a point-to-point format.

7. The combination of claim 6 further comprising means for selectively holding said latch means in a non-latching state whereby the digital count value in said counting means is provided to said digital to analog converter to record said rate of penetration signal in a bar pattern format.

8. The combination of claim 4 further comprises divider means and means for selectively connecting said divider means in series between said depth signal means and at least one of said retriggerable monostable units.

* * * * *

UNITED STATES PATENT AND TRADEMARK OFFICE

CERTIFICATE OF CORRECTION

PATENT NO. : 4,512,186

DATED : April 23, 1985

INVENTOR(S) : Bruce K. Edwards

It is certified that error appears in the above-identified patent and that said Letters Patent is hereby corrected as shown below:

Column 9, line 7, change "The combination of claim 6" to --The combination of claim 5--.

Signed and Sealed this

*Twelfth* Day of *November 1985*

[SEAL]

*Attest:*

DONALD J. QUIGG

*Attesting Officer*

*Commissioner of Patents and Trademarks*